United States Patent [19]

Sander et al.

[11] 3,992,344

[45] Nov. 16, 1976

[54] PRODUCTION OF NON-FOAMING AQUEOUS SUSPENSIONS OF POLYETHYLENE OR POLYPROPYLENE FIBRIDS

[75] Inventors: Bruno Sander, Ludwigshafen; Eckhard Bonitz, Frankenthal; Heinz Berbner, Moerlenbach; Manfred Hoffmann, Ludwigshafen, all of Germany

[73] Assignee: BASF Aktiengesellschaft, Ludwigshafen (Rhine), Germany

[22] Filed: Nov. 19, 1975

[21] Appl. No.: 633,292

Related U.S. Application Data

[62] Division of Ser. No. 515,550, Oct. 17, 1974, Pat. No. 3,950,293.

[30] Foreign Application Priority Data

Oct. 18, 1973 Germany ..... 2352190

[52] U.S. Cl. ..... 260/29.6 RW; 162/12; 260/17 R; 260/17.4 CL; 260/29.6 NR

[51] Int. Cl.[2] ..... C08L 23/02

[58] Field of Search ..... 260/29.6 NR, 29.6 RW, 260/17, 17.4 CL; 162/12

[56] References Cited

UNITED STATES PATENTS

| | | | |
|---|---|---|---|
| 3,743,570 | 7/1973 | Yang et al. | 162/157 R |
| 3,834,983 | 9/1974 | Conway et al. | 162/168 |

OTHER PUBLICATIONS

Chem. Absts.: 78:45335q (1973), Yang et al.; "Water–Dispensible Polyolefin Fibers".

*Primary Examiner*—Edward M. Woodberry
*Attorney, Agent, or Firm*—Johnston, Keil, Thompson & Shurtleff

[57] ABSTRACT

Aqueous suspensions of polyolefin fibrids are prepared. To avoid foam formation and improve fiber-bonding, small amounts of anionic agents are added to the suspensions. The suspensions are suitable for the manufacture of paper-like or textile-like web structures distinguished by very good fiber bonding and good initial wet strength.

5 Claims, No Drawings

PRODUCTION OF NON-FOAMING AQUEOUS SUSPENSIONS OF POLYETHYLENE OR POLYPROPYLENE FIBRIDS

This is a division of application Ser. No. 515,550 filed Oct. 17, 1974, now U.S. Pat. No. 3,950,293.

This application discloses and claims subject matter described in German patent application No. P 23 52 190.6, filed Oct. 18, 1973, which is incorporated herein by reference.

This invention relates to a process for the manufacture of aqueous suspensions of polyolefin fibrids by dispersing said fibrids in water in the presence of a dispersing agent.

It is well known that polyolefin fibrids, which are hydrophobic by nature, may be dispersed in water when surface-active substances are used as dispersing agents. Such surfactants are generally composed of hydrophilic and hydrophobic segments, the hydrophilic properties being produced by polyethylene oxide units. The preferably terminal hydrophobic segments comprise for example polypropylene oxide units, alkyl phenol radicals, urethane groupings and fatty alcohol radicals.

However, the use of these dispersing agents suffers from the drawback that both in the manufacture and in the processing of such aqueous suspensions of polyolefin fibrids marked foaming frequently takes place. The counteract this, it is often necessary to use anti-foaming agents in not inconsiderable amounts. It has also been found that the use of such wetting agents or the mixtures of wetting agents and antifoaming agents causes a marked reduction in the initial wet strength of paper sheets which have been made, for example, from polyethylene fibrids and cellulose fibers.

It is an object of the invention to modify the above process in such a manner that the said drawbacks no longer occur. Minimum addition of the dispersing agents should provide ideal dispersion of the polyolefin fibrids in water and should cause no foaming during manufacture and processing of the suspension, particularly during processing in paper machines. The presence of such agents must not impair the bond between the synthetic fibrids or between these fibrids and cellulose fibers, if present, but rather should afford an improvement of said bond so as to give good initial wet strength of the webs.

We have found that the above objects are achieved when the dispersing agent used comprises 0.1 to 2.0% by weight, based on the dry weight of the fibrids, of an anionic protective colloid.

Suitable anionic protective colloids are, for example, condensates of formaldehyde and an alkali metal or ammonium salt of $\beta$-naphthalenesulfonic acid. We prefer to use a condensate of formaldehyde and the sodium salt of $\beta$-naphthalenesulfonic acid. Other suitable anionic protective colloids are polycondensates of urea, formaldehyde and alkali metal or ammonium salts of phenolsulfonic acids. It is possible to use a mixture of isomeric phenolsulfonic acid. We prefer to use the sodium salt. The said components may be condensed with each other over a wide range of molar proportions. The viscosity of a 2% aqueous solution of the polycondensate is from 1.1 to 3.0 centipoise (Hoeppler) at a temperature of 20° C.

Further suitable anionic protective colloids are urea/formaldehyde polycondensates which have been modified with sodium bisulfite or melamine/formaldehyde polycondensates which have been modified with sodium bisulfite. The molar ratio of the starting materials urea or melamine to formaldehyde to sodium bisulfite may vary within wide limits and may be between 0.1 and 10:0.2 and 20:0.01 and 1. The viscosity of a 2% aqueous solution of said polycondensate is from about 1.1 to 3.0 centipoise (Hoeppler) at a temperature of 20° C.

By anionic protective colloid we also means the alkali metal and ammonium salts of carboxymethylcellulose. The viscosity of a 2% aqueous solution of said dispersing agent is from 1 to 500 centipoise (Hoeppler) at 20° C. In our process, we prefer to use the sodium salt of carboxymethylcellulose. The alkali metal and ammonium salts of copolymers of maleic acid and vinyl isobutyl ether and such salts of copolymers of styrene and acrylic acid are also effective as anionic protective colloids. In the present process, it is preferred to use the ammonium salts of said copolymers. The viscosity of a 40% aqueous solution is generally from about 2,000 to 30,000 centipoise at 20° C and is preferably in the range from 5,000 to 15,000 centipoise. The viscosity of the solutions and the composition of the copolymers may be varied within wide limits.

It is a special feature of the present invention that very small amounts of said substances are sufficient to cause very fine dispersion of the hydrophobic polyolefin fibrids in water. Rates of application of more than 2% by weight, based on the dry weight of the fibers, tend to be detrimental and uneconomical.

When the suspensions in the process of the invention are used for the manufacture of paper-like or textile-like webs on paper machines or wet-web machines, no foaming occurs. The webs may be readily removed from the wires of the machines. The fibrids prepared in the present invention are particularly suitable for the manufacture of blended webs containing said polyolefin fibrids and also cellulose fibers. The resulting webs of a paper-like or textile-like nature are distinguished by very good fiber bonding and good initial wet strength.

The polyolefin fibrids are manufactured in conventional manner. For example, a pressurized solution of the polyolefin is forced through a narrow die into a chamber containing either a gaseous medium (air or nitrogen) or a liquid medium (water or an organic precipitant). In a preferred embodiment, the polyolefin solution is forced through a circle of nozzles to be dispersed in a turbulent field of shear forces produced in an impulse exchange chamber situated downstream of the die orifices by a jet of an auxiliary gas or liquid emerging concentrically with said circle of nozzles.

In another procedure, a solution of the polyolefin is dispersed in a precipitant and the polymer is precipitated under shear.

The fibrids obtained by said processes are similar to cellulose fibers in size and shape. They differ from staple fibers in that they have a relatively large specific surface area (from 1 to 150 $m^2/g$) and are capable of forming a web when deposited onto a wire from aqueous suspension.

By polyolefins we mean, in particular, polyethylenes and polypropylenes. The density of the polyethylenes may be between 0.915 and 0.965 $g/cm^3$. The melt index of the polyethylenes is preferably from 0.01 to 100 g/10 min, as determined according to ASTM D 1238-65 T at 190° C under a load of 2.16 kg. The polyethylenes are prepared by the well-known high-pressure or low-pressure polymerization processes. Copolymers of ethylene with vinyl acetate, n-butyl acrylate, isobutyl acrylate or t-butyl acrylate or with acrylic acid and/or other comonomers are also suitable. Suitable polypropylenes are those having an intrinsic viscosity of from 1.5 to 8 dl/g, as measured at 130° C in decalin.

The dispersing agents are used in the process of the invention in the form of their aqueous solutions. The amount of dispersing agent used is from 0.1 to 2% and preferably from 0.3 to 1%, by weight of the dry weight of the fibrids.

The polyolefin fibrid suspensions are prepared, for example, by transferring the hydrophobic polyolefin fibrids to a specific amount of water with stirring, this water containing the dissolved dispersing agent. The resulting pulp is then stirred for from 5 to 15 minutes with a high-speed propeller stirrer. The solids concentration is generally from 0.5 to 10% and preferably from 1 to 5%, by weight.

The resulting fibrids suspension may be diluted with water as required and then converted to paper-like or textile-like webs on a paper machine or web-making machine.

The treated polyolefin fibrids may be isolated from the suspension by suction filtration or pressure or by centrifuging. The separated mass of fibrids has a water content of from 75 to 85% by weight. In this form, the fibrids are suitable for transportation and storage. The fibrids prepared by the process of the invention may be redispersed in water even after relatively long periods of storage. The fiber concentration in the suspensions formed by redispersion of the treated fibrids may also vary within wide limits. If water is used as auxiliary medium in the manufacture of the fibrids or for mechanically disentangling the crude fibers, the dispersing agent of the invention may be applied to the fibrids at this stage.

The parts and percentages specified below are by weight.

The initial wet strength is that determined used the tester developed by W. Brecht and H. Fiebinger (see Karl Frank, Taschenbuch der Papierprufung, 3rd enlarged edition, published by Edward Roether Verlag, Darmstadt, 1958, p. 59).

Specimen strips measuring 30 × 95 mm are prepared from the fibers or fiber mixtures to be tested in a web-forming device by the use of a frame. The thickness of the test strips (weight per unit area) is governed by the solids concentration of the suspension. The testing apparatus is then used to determine the load, in grams, at which the test strips tear. Since the results depend not only on the weight per unit area but also, to a marked degree, on the water content of the fibers, the latter must be determined for each test. The following data on the initial wet strength refer to test strips having a water content of from 83 to 84% by weight.

MANUFACTURE OF FIBRIDS FROM A LOW-DENSITY POLYETHYLENE

A branched-chain polyethylene having a density of 0.918 g/cm$^3$, a melt index of 20 g/10 min. (190° C/2.16 kg) and a softening point of 105° C is melted in a twin-worm extruder. n-Pentane is added to the molten polymer through a metering pump such that the mixture extruded consists of a homogeneous polymer solution of 83% of n-pentane and 17% of polyethylene. This polymer solution is extruded through a circle of dies each having a diameter of 0.7 mm, the extrudate passing into a precipitating bath filled with water. Downstream of said dies and at a distance of 8 mm there is disposed a tube having a length of 15 cm and a diameter of 2.5 cm. A jet of water having a velocity of 40 m/sec. is directed toward this tube serving as impulse exchange chamber through a nozzle disposed at the center of the circle of dies and having a diameter of 2 mm. The temperature of the water is 18° C. The resulting pulp is freed from n-pentane by heating to 45° C.

EXAMPLES 1 to 5

Dispersion action of various agents compared with a dispersing agent of the invention Use is made of the fibrids of polyethylene of low density as manufactured by the above method, which have been freed from n-pentane but not yet disentangled. The dispersing agents to be tested are added to the medium in which the fibers are disentangled.

For disentanglement of the fibers, 2 liters of water and 1.0 g (0.34% based on dry fiber) of dispersing agent as listed in Table 1 below are placed in a 3 liter suction flask. 34 g (dry weight) of the hydrophobic crude fibers are then uniformly spread over the surface of the water. The shearing head of the disentangling apparatus (Ultra-Turrax T 45/N, 390 W/10,000 rpm) is then placed in the middle of the aqueous phase. After a disentangling time of 3 minutes, the apparatus is stopped and the rate at which the phases separate is determined. After a further 2 minutes, the height of the fiber-free liquid phase is measured. The results are listed in Table 1 below. The dispersing action of the dispersing agent added is inversely related to the height of the fiber-free layer.

TABLE 1

| | Dispersing agent | Height of fiber-free layer (mm) |
|---|---|---|
| Comp. Ex. 1 | ethylene oxide/propylene oxide polyadduct, molar ratio 1:1.1, mol. wt. about 3,000 | 55 |
| Comp. Ex. 2 | p-nonylphenyl ethoxylate containing 10 moles of ethylene oxide | 55 |
| Comp. Ex. 3 | ethoxylated fatty acid ester (ZONYL A) | 45 |
| Ex. 1 | polycondensate of urea, formaldehyde and the sodium salt of phenolsulfonic acid, molar ratio 1:2:2, viscosity of 2% aqueous solution 1.22 centipoise at 20° C (Hoeppler) | 15 |
| Ex. 2 | urea/formaldehyde polycondensate modified with sodium bisulfite, viscosity of 2% aqueous solution 1.18 centipoise at 20° C (Hoeppler) | 15 |
| Ex. 3 | sodium salt of carboxymethylcellulose, viscosity of 2% aqueous solution 100 centipoise at 20° C (Hoeppler) | 10 |
| Ex. 4 | ammonium salt of a copolymer of maleic acid and | |

TABLE 1-continued

| | Dispersing agent | Height of fiber-free layer (mm) |
|---|---|---|
| | vinyl isobutyl ether, molar ratio 1:1, viscosity of 40% aqueous solution 11,000 centipoise at 20° C | 15–20 |
| Ex. 5 | ammonium salt of a copolymer of styrene and acrylic acid, molar ratio 1:6:1, viscosity of 20% aqueous solution 2,500 centipoise at 20° C. | 20 |

When using the dispersing agents given in Examples 1 to 5, there is a substantially even distribution of the polyolefin fibrids in the aqueous phase, whereas the use of the dispersing agents of the prior art (Comparative Examples 1 to 3) causes the fibrids to float on the liquid phase.

Results obtained when using the aqueous polyolefin fibrid suspensions in the production of sheets of paper, compared with polyolefin fibrids suspensions not of the invention The fibrids treated according to Table 1 are filtered off and their moisture content is determined. For the preparation of blended paper, 2 g (dry weight) of fibrid are dispersed in 1 l of water for 1 minute with stirring together with 2 g of sulfite cellulose (35° SR). The suspension of fibers is then passed to a web-forming machine containing 3 l of water.

The samples provided according to Comparative Examples 1 to 3 produce marked foaming. The fibers are not dispersed uniformly and the resulting sheets of paper show inconsistent distribution of the latter with only poor fiber bonding.

By contrast, the fibers treated according to Examples 1 to 5 disperse well in water without foaming to produce a blended paper showing uniform distribution of the individual fibers.

Production of fibrids of high-density polyethylene

A linear polyethylene having a density of 0.96 g/cm$^3$, a melt index of 4.5 g/10 min. (190° C/2.16 kg) and a softening point of 135° C is dissolved in petroleum ether (b.p. 65°–95° C. density 0.96 g/cm$^3$) in a stirred vessel at a temperature of 150° C and a pressure of 7.5 atmospheres gage. The resulting crude fibers are disentangled for 3 minutes by high-frequency treatment with an Ultra-Turrax machine (390 W/10,000 rpm) at a solids content of 1.5% in petroleum ether. The fibrids are filtered off and freed from residual petroleum ether by heating in a stream of nitrogen at 50° C. The resulting fibrids have a very fine texture and are thin and crimped. They are similar to cellulose fibers.

EXAMPLES 6 to 11

The fibrids of high-density polyethylene obtained as described above are treated with the dispersing agents listed below and are then used, together with cellulose, for the manufacture of sheets of paper. The following dispersing agents were used in the Examples:

Comp. Ex. 4: ethylene oxide/propylene oxide polyadduct, molar ratio 1:1.1, mol. wt. about 3,000.

Comp. Ex. 5: p-nonylphenol ethoxylate containing 10 moles of ethylene oxide.

Comp. Ex. 6: ethoxylated fatty acid ester (ZONYL A).

Ex. 6: polycondensate of urea/formaldehyde/sodium salt of phenolsulfonic acid, molar ratio 1:2:2, viscosity of a 2% aqueous solution at 20° C being 1.22 centipoise (Hoeppler).

Ex. 7: a urea/formaldehyde polycondensate modified with sodium bisulfite and having a viscosity of 1.18 centipoise (Hoeppler) in 2% aqueous solution at 20° C.

Ex. 8: sodium salt of carboxymethylcellulose having a viscosity of 100 centipoise (Hoeppler) at 20° C in 2% aqueous solution.

Ex. 9: condensate of formaldehyde and the sodium salt of $\beta$-naphthalenesulfonic acid.

Ex. 10: ammonium salt of a copolymer of maleic acid and vinyl isobutyl ether, molar ratio 1:1. The viscosity of a 40% aqueous solution at 20° C is 11,000 centipoise.

Ex. 11: ammonium salt of a copolymer of styrene and acrylic acid, molar ratio 1.6:1. The viscosity of a 20% aqueous solution at 20° C is 2,500 centipoise.

Treatment of fibrids with dispersing agents 40 g of fibrids are stirred into 1 liter of water containing 1.5 g (1% w/w based on dry fibers) of a dissolved dispersing agent. Stirring is continued for 20 minutes and the whole is allowed to stand for 2 to 3 hours. The fibrids are then isolated by filtration.

Manufacture of sheets of paper 2 g (dry weight) of the treated fibrids and 2 g of sulfite cellulose (35° SR) are dispersed in 1 liter of water for 1 minute with stirring. The suspension of fibers is then passed to a sheetforming machine containing 3 liters of water.

The initial wet strength of sheets of paper having various proportions of cellulose for a given weight per unit area (approx. 130 g/m$^2$) is determined by the method described above.

The results of observations and measurements are listed in Tables 2 and 3 below.

TABLE 2

| Dispersing agent of | Behavior on sheet-forming equipment foam formation | agglomeration | Addition of antifoaming agent | Assessment of paper fiber bonding | distribution |
|---|---|---|---|---|---|
| Comp. Ex. 4 | yes | yes | yes$^+$ | poor | uneven |
| Comp. Ex. 5 | yes | yes | yes$^+$ | poor | uneven |
| Comp. Ex. 6 | yes | yes | yes$^+$ | poor | uneven |
| Example 6 | no | no | no | very good | even |
| Example 7 | no | no | no | very good | even |
| Example 8 | no | no | no | very good | even |
| Example 9 | no | no | no | very good | even |

TABLE 2-continued

| Dispersing agent of | Behavior on sheet-forming equipment foam formation | agglomeration | Addition of antifoaming agent | Assessment of paper fiber bonding | distribution |
|---|---|---|---|---|---|
| Example 10 | no | no | no | very good | even |
| Example 11 | no | no | no | very good | even |

$\underline{x}$ it was necessary, to destroy the foam, to add from 2 to 3 $cm^3$ of a commercial antifoaming agent in each case.

TABLE 3

| Dispersing agent | Initial wet strength of a blended paper containing 70% of fibrids | 50% of fibrids | 30% of fibrids |
|---|---|---|---|
| Comp. Ex. 4 | 60 | 100 | 160 |
| Comp. Ex. 5 | 60 | 120 | 185 |
| Comp. Ex. 6 | 60 | 110 | 165 |
| Example 6 | 140 | 200 | 260 |
| Example 7 | 135 | 200 | 280 |
| Example 8 | 140 | 175 | 270 |
| Example 9 | 135 | 190 | 270 |
| Example 10 | 220 | 260 | >300 |
| Example 11 | 250 | 280 | >300 |

The Examples show the sharp increase in initial wet strength of the blended papers of cellulose fibers and polyethylene fibrids when treated with the dispersing agents of the invention.

Manufacture of paper webs of polyethylene fibrids without the addition of cellulose Paper webs are prepared from the polyethylene fibrids of high density as treated in Examples 10 and 11. The initial wet strengths are measured on test specimens having a weight of 130 $g/m^2$.

Results

It was possible to produce paper webs consisting of 100% polyethylene fibrids without the formation of foam or agglomerates, the individual fibers showing good and uniform distribution.

The following initial wet strengths were found:

fibrids of Ex. 10: 190 g
fibrids of Ex. 11: 220 g

We claim:

1. A process for the manufacture of non-foaming aqueous suspensions of polyolefin fibrids by dispersing polyethylene fibrids or polypropylene fibrids in water in the presence of a dispersing agent, said fibrids having a specific surface area of 1–150 $m^2/g$, the improvement wherein the dispersing agent used consists of from 0.1 to 2.0% by weight, based on the dry weight of the fibrids, of an ammonium salt of a copolymer of maleic acid and vinyl isobutyl ether.

2. A process as claimed in claim 1, said ammonium salt having a viscosity of a 40% aqueous solution thereof at 20° C in the range of 2,000 to 30,000 centipoise.

3. A process as claimed in claim 1, said ammonium salt having a viscosity of a 40% aqueous solution thereof at 20° C in the range of 5,000 to 15,000 centipoise.

4. A process as claimed in claim 1 wherein said fibrids are polyethylene fibrids in which the polyethylene has a density between 0.915 and 0.965 $g/cm^3$ and a melt index of 0.01 to 100 g/10 min. as determined according to ASTM D 1238-65 T at 190° C under a load of 2.16 kg.

5. A process as claimed in claim 1 wherein said fibrids are polypropylene fibrids in which the polypropylene has an intrinsic viscosity of from 1.5 to 8 dl/g, as measured at 130° C in decalin.

* * * * *